US010512947B2

(12) United States Patent
Ho

(10) Patent No.: US 10,512,947 B2
(45) Date of Patent: Dec. 24, 2019

(54) METHOD AND APPARATUS FOR SMART TOILET MINIMIZING WATER USAGE

(71) Applicant: Walter Ho, Santa Monica, CA (US)

(72) Inventor: Walter Ho, Santa Monica, CA (US)

( * ) Notice: Subject to any disclaimer, the term of this patent is extended or adjusted under 35 U.S.C. 154(b) by 317 days.

(21) Appl. No.: 15/405,266

(22) Filed: Jan. 12, 2017

(65) Prior Publication Data

US 2017/0159275 A1 Jun. 8, 2017

Related U.S. Application Data

(63) Continuation-in-part of application No. 13/942,296, filed on Jul. 15, 2013, now abandoned.

(51) Int. Cl.

| | |
|---|---|
| ***B08B 3/12*** | (2006.01) |
| ***A47K 11/12*** | (2006.01) |
| ***E03D 5/12*** | (2006.01) |
| ***E03D 13/00*** | (2006.01) |
| ***B06B 1/06*** | (2006.01) |
| ***E03D 11/02*** | (2006.01) |
| ***E03D 11/10*** | (2006.01) |
| ***E03D 1/14*** | (2006.01) |

(52) U.S. Cl.

CPC ..... *B08B 3/12* (2013.01); *A47K 11/12* (2013.01); *B06B 1/06* (2013.01); *E03D 1/14* (2013.01); *E03D 5/12* (2013.01); *E03D 11/025* (2013.01); *E03D 11/10* (2013.01); *E03D 13/007* (2013.01)

(58) Field of Classification Search

CPC ..... B08B 3/12; A47K 11/12
USPC ..... 4/313
See application file for complete search history.

(56) References Cited

U.S. PATENT DOCUMENTS

2014/0137357 A1* 5/2014 Ralea ..... E03D 9/00 15/246

* cited by examiner

*Primary Examiner* — Christine J Skubinna
(74) *Attorney, Agent, or Firm* — A. N. Seidman

(57) ABSTRACT

An apparatus and method for a toilet which minimizes water usage and that can handle both urine and fecal matter. An ultrasonic vibration cleaner unit is disposed to clean at least one fecal plate which is rotated into a lower part of a toilet bowl containing water. Occasional and periodic flushing of solid fecal matter results in less water usage than utilizing water flushing for cleaning and carrying away of solid fecal matte each time of use.

14 Claims, 15 Drawing Sheets

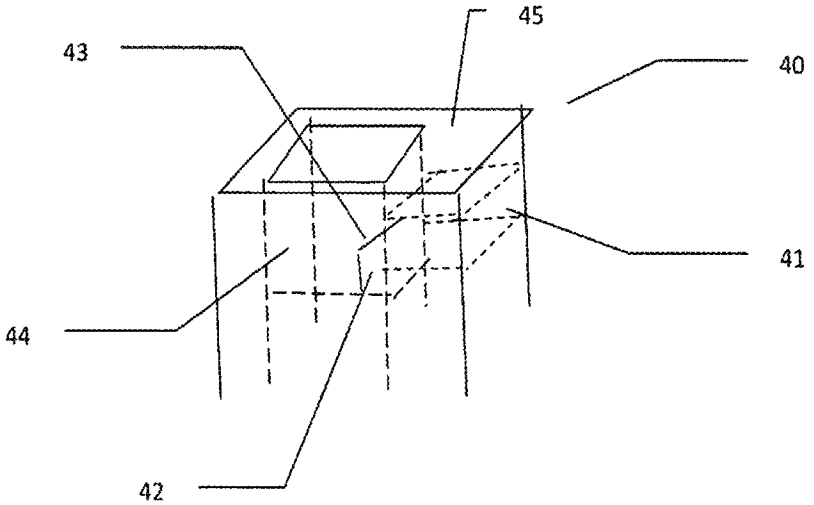
Figure 2-Prior Art

METHOD AND APPARATUS FOR SMART TOILET MINIMIZING WATER USAGE

This continuation-in-part application claims the priority of the non-provisional application Ser. No. 13/942,296 filed Jul. 15, 2013.

FIELD OF THE INVENTION

This invention relates to waterless urinals.
This invention relates to waterless toilets.

BACKGROUND OF THE INVENTION

In a world with resources limited relative to world population, decreasing the use of water for flushing of fecal matter is an area of plumbing improvement which recommends itself. With a population, which is becoming increasingly urbanized, potentially 6 billion flushes per day, at one gallon of water per flush, derated to a third, leaves 2 billion gallons of potential water saving. The present invention is in reference to a modern urban sewage system, such as may currently be found in Los Angeles or New York, where there is a source of input water for flushing a toilet and there is a waste water piping system into which a toilet may be flushed and which has sanitary standards.

Utilizing a bell trap with n oil-type odor-trap fluid, waterless urinals have been successfully implemented, e.g., U.S. Pat. No. 5,711,037 (Reichardt, et al., 1998), U.S. Pat. No. 7,111,332 (Hsia, 2006). U.S. Pat. No. 8,234,723 (Allen, 2012), and U.S. Pat. No. 8,291,522 (Kueng, 2012).

Utilizing a recirculating pump, Roberts (U.S. Pat. No. 4,222,139, 1980) implemented a waterless flush toilet. This was not limited to, but noted for, buses.

A combined flush toilet and waterless urinal was shown by Abney (U.S. Patent Application Publication 2004/0098799, 2004). It utilized a waterless urinal in one bowl and a separate bowl for a flush toilet, combined as one unit.

SUMMARY OF THE INVENTION

The present invention, in a preferred mode, utilizes a movable fecal plate where the movable fecal plate moves past a fixed waterless urinal capsule, with a cleaner unit which cleans the fecal carrier plate.

The cleaner unit is preferably an ultrasonic cleaner unit which uses high frequency vibrations which are communicated to the water in the lower part of the toilet bowl to produce cavitation bubbles, and which implode and act to clean. The ultrasonic vibration may apply high-frequency vibration to the fecal plate while the fecal plate is submerged in a water.

The fecal plate may be formed as one of as an array of rotating fecal plates on an axis.

The may be operated by a foot-pedal mechanical linkage or by electrical motor means.

The main cleaning function for fecal matter depends on an ultrasonic vibrator. The aim of this functionality is to conserve water, with only occasional and periodic flushing required, to remove solid waste build-up only; the main cleaning per fecal deposit being done by the ultrasonic vibrator cleaning unit.

The same type of lighter-than-water urinal odor trap oil/fluid may also be kept as a sealant over the water in the main toilet bowl.

BRIEF DESCRIPTION OF THE DRAWINGS

For a more complete understanding of the present invention, and the advantages thereof, reference is now made to the following descriptions taken in conjunction with the accompanying drawings, in which:

(Prior Art) FIG. 2 shows a more detailed view of a fixed bell-trap waterless urinal;

DETAILED DESCRIPTION OF THE BEST MODES

The following description is of the best mode presently contemplated for carrying out the invention. This description is not to be taken in a limiting sense, but is merely made for describing the general principles of the invention. The scope of the invention should be determined with reference to the claims.

Figure 1:
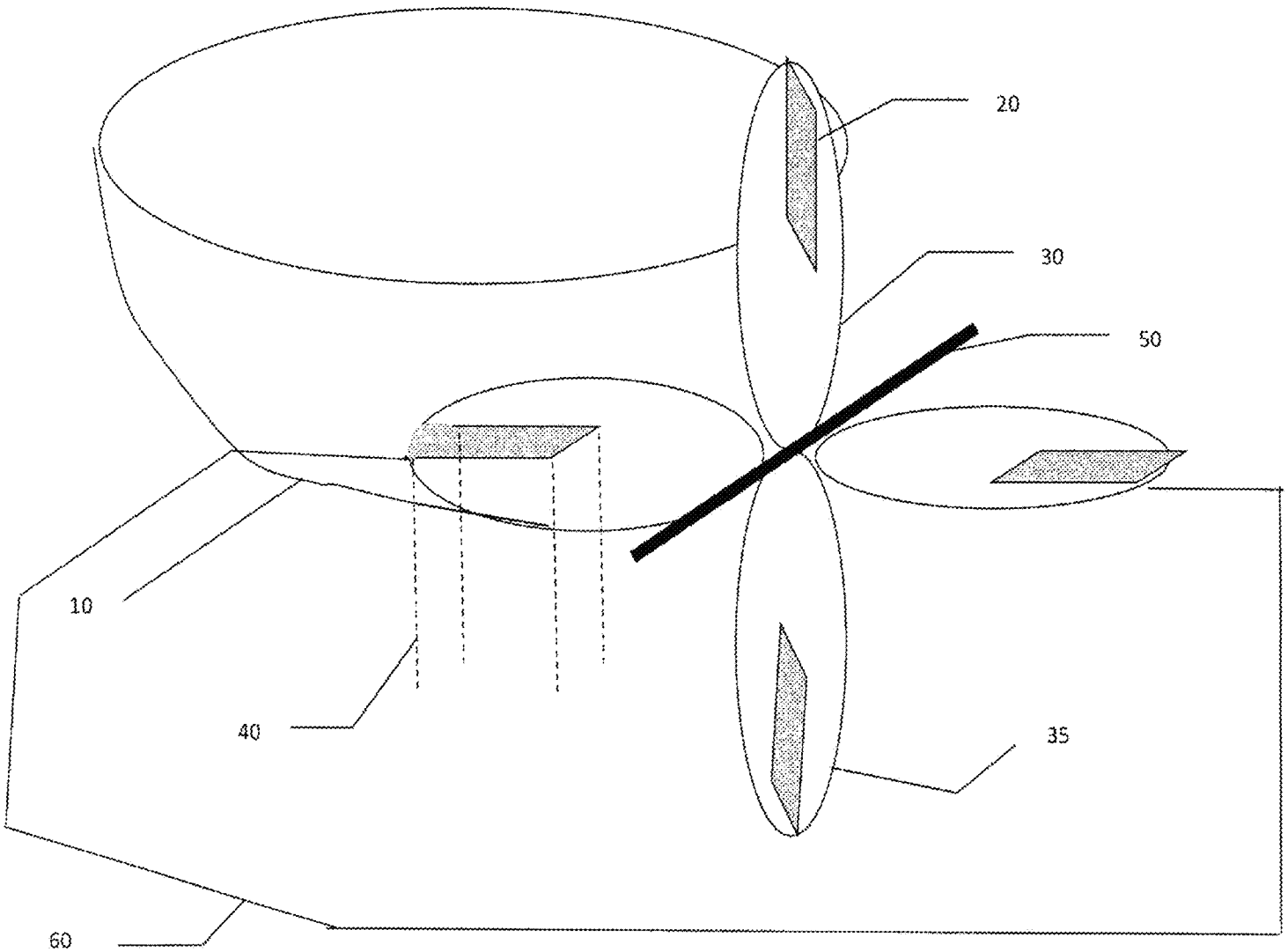
FIG. 1 shows an exemplary arrangement of the fecal plate disposed in a rotary fashion, with a fixed bell-trap waterless urinal arrangement.
Figure 1A:
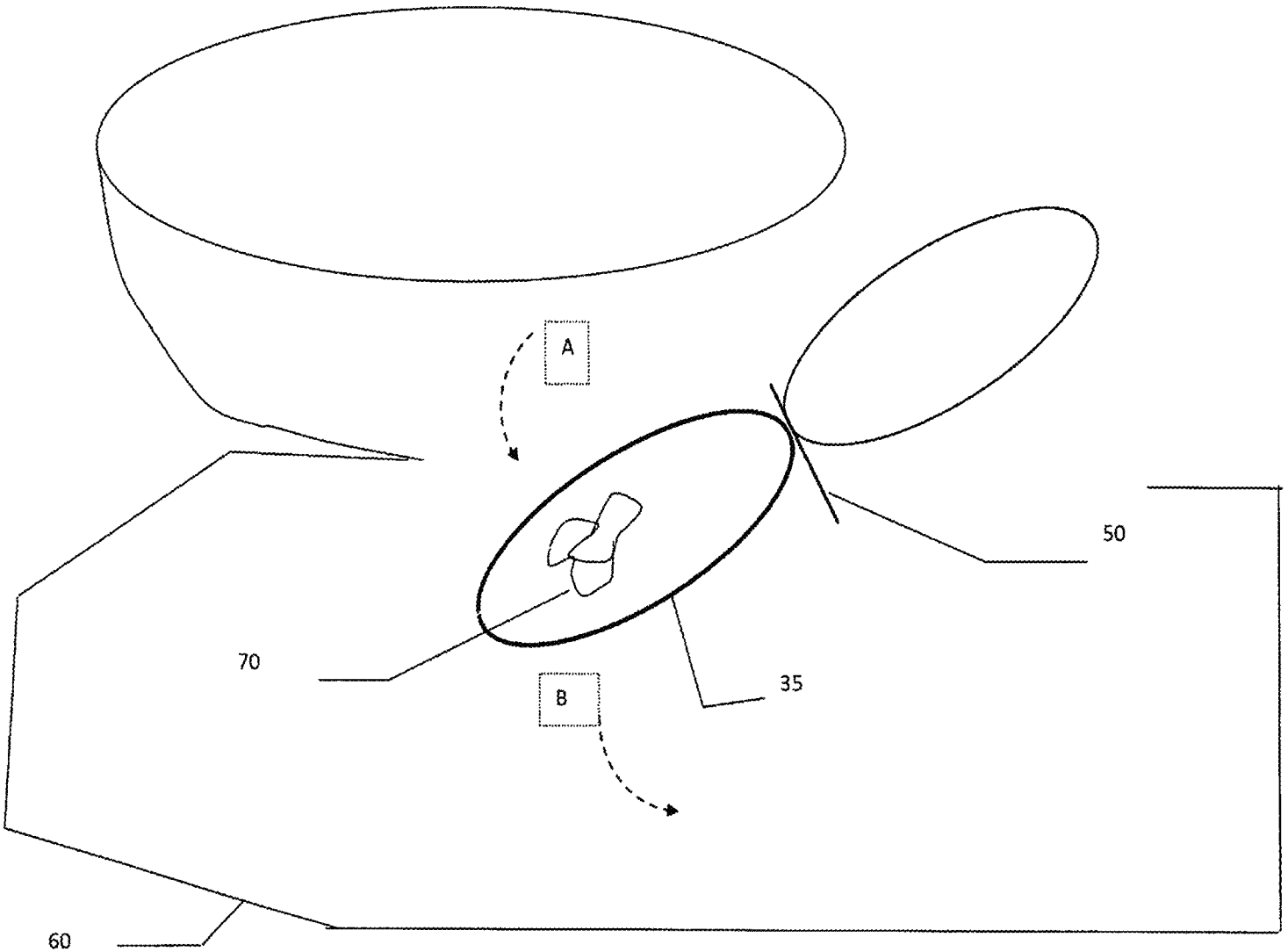

FIG. 1 shows the arrangement of the toilet bowl 10 Together with a fixed waterless urinal 40 and the rotating fecal plates 30, 35 with a cut-out 20 for the fixed waterless urinal 40. An axis of rotation 50 for the rotating fecal plates 30, 35 is shown. The axis of rotation can thus be driven by Mechanical or electrical means, and can be synchronized with any co-ordinate sealing operation pr mechanism, which operates to seal the fecal plate to the fixed waterless urinal 40. The lower part of the toilet bowl 60 contains water. The fecal plates 30, 35 are rotated successively so that when one of the fecal plates 30 has received fecal matter, it is rotated down into water, as the fecal plate 35 is shown, and a successive fecal plate 30 is rotated into a position to receive feces. FIG. 1*a* shows diagrammatically the accumulated weight of fecal matter 70 on the fecal plate 35 in a gravity operated mechanism disposes the fecal matter to rotate down A, B, to the lower part of the toilet bowl 60 that contains water.

FIG. 2 (prior art) shows an exemplary fixed waterless urinal 40, shown here in a bell trap of square shape. There is an upper surface 45 and a volume of lighter-than-water oil/fluid 41 which floats on a volume of water 42 which is limited by a lip 43, and which empties into an interior exiting pipe 44 which connects to the waste water system (not shown).

Figure 3:
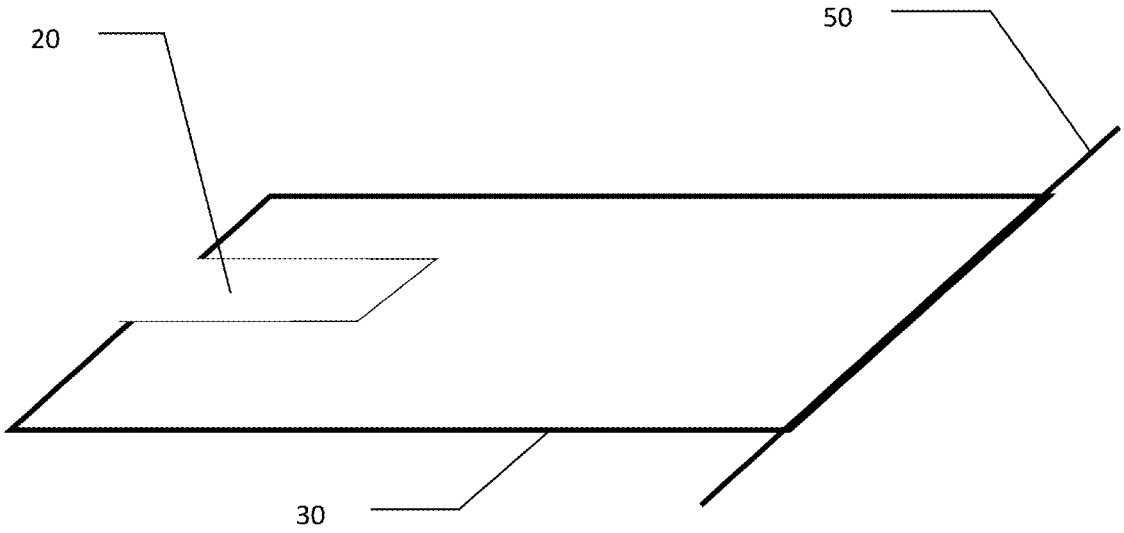
FIG. 3 shows the fecal plate schematically, with a cut-out for the fixed waterless urinal.

FIG. 3 shows a fecal plate 30, schematically, with a cut-out 20 to allow it to accommodate the fixed waterless urinal structure. An axis 50 for rotating the fecal plate is shown. The invention is not limited to four fecal plates; for example, three or two plates could be rotated around instead of four fecal plates. A single fecal plate could also be used; it does not have to rotate around but could drop down into a position to be cleaned and after a sufficient interval, readily determined by the effectiveness of the ultrasonic vibration cleaning unit, it could be returned into its starting position.

Figure 4:
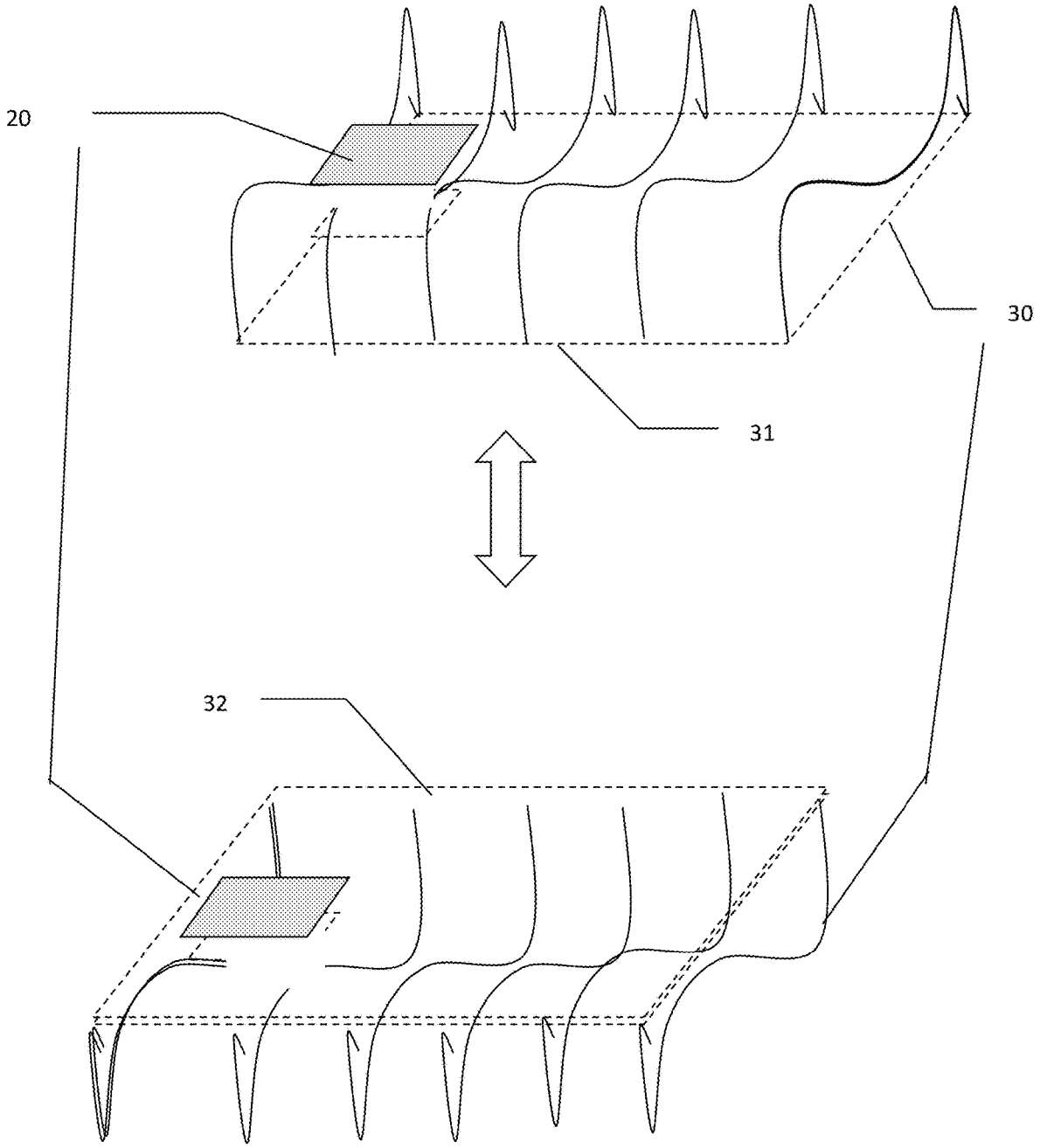
FIG. 4 shows an exploded view of a fecal plate for the rotary arrangement, with an upper surface disposed to act as a fecal collector and a lower surface disposed to conform to the inner shape of the toilet bowl.

FIG. 4 depicts the contours 31, 32, of a fecal plate 30 that is rotated from an upward position with a curved inner surface 32 to match the inside contours of the toilet bowl (FIG. 1, 10). The side 31 of the fecal plate 30 disposed to receive feces is contoured to urge the flow of urine toward the fixed waterless urinal unit (FIG. 1, 40).

Figure 5A:
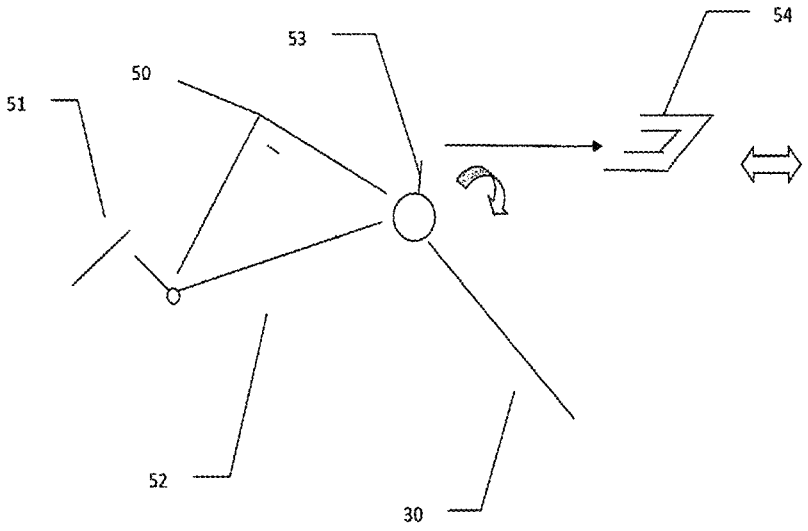
FIG. 5*a* shows schematically a foot pedal operation which acts to rotate a next fecal plate into position while it lowers a fecal plate into the water in the lower part of the toilet bowl where it is subject to cleaning by the vibrations of the ultrasonic cleaner unit.

FIG. 5*a* shows a schematic arrangement for a (manual) foot-operated approach to rotate, I.e., equivalent to 'flushing' the toilet, the fecal plate(s). A foot pedal and lever 51 acts though a cranking arm 52 to engage a protrusion 53 on the rotation axis 50 which has attached at least one fecal plate 30 which gets rotated from a first position to a second position. This motion can also urge a sliding cover 54 to slide away while the fecal plate 30 is rotating and engages again to securely cover the lower part (FIG. 8, 90) of the toilet bowl FIGS. 1 and 8, 10) by engaging the fecal plate 30 and the fixed waterless urinal unit (FIG. 1, 40). It will be appreciated that these types of mechanisms can be implemented by electrical and electro-magnetic means of small motors.

Figure 5B:
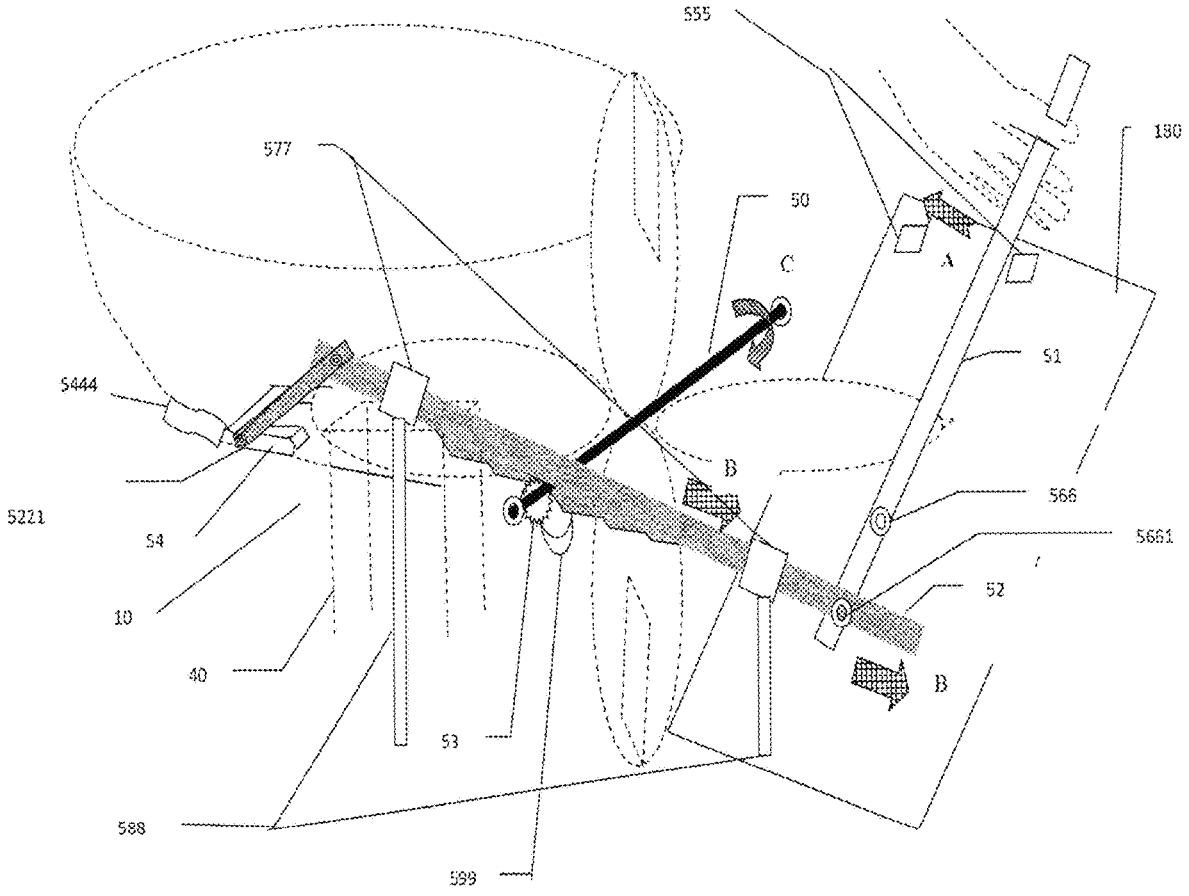
FIG. 5*b* shows a lever, which can be moved toward the toilet. An extension arm extends to the sliding cover which is slid back to open and is returned by a horizontally operating spring. Thus, in usage, the horizontal fecal plate receiving fecal matter is then moved immediately down into the lower part containing water.

FIG. 5*b* shows a lever 51, which can be moved toward the toilet (motion direction indicated at A). Pivot points are at 566 and 5661. Arm 52 is moved in direction B, sliding on supports 577. The upper pivot 566 is fixed, the lower pivot 5661 rotatingly connects arms 51 and 52. The supports 588 are shown for the hollow cylindrical supports 577. Arm 51 motion is limited by stops 555. Arm 52 has teeth which engage with gear 53, which is constrained to move in one direction by pawl 599. An extension arm 5221 extends to the sliding cover 54 which is slid back to open and is returned by a horizontally operating spring 5444. (In this figure, the directions of motion A, B and C are shown the reverse of the direction as actually is made to occur, for purposes of clarity in drawing. Thus, in usage, the horizontal fecal plate receiving fecal matter is then moved immediately down into the lower part containing water. This illustration convention pertains to FIGS. 5B, 5*c*, 5*d* and 5*e*). Support 180 is for limits 555 and pivots 566 and 5661.

Figure 5C:
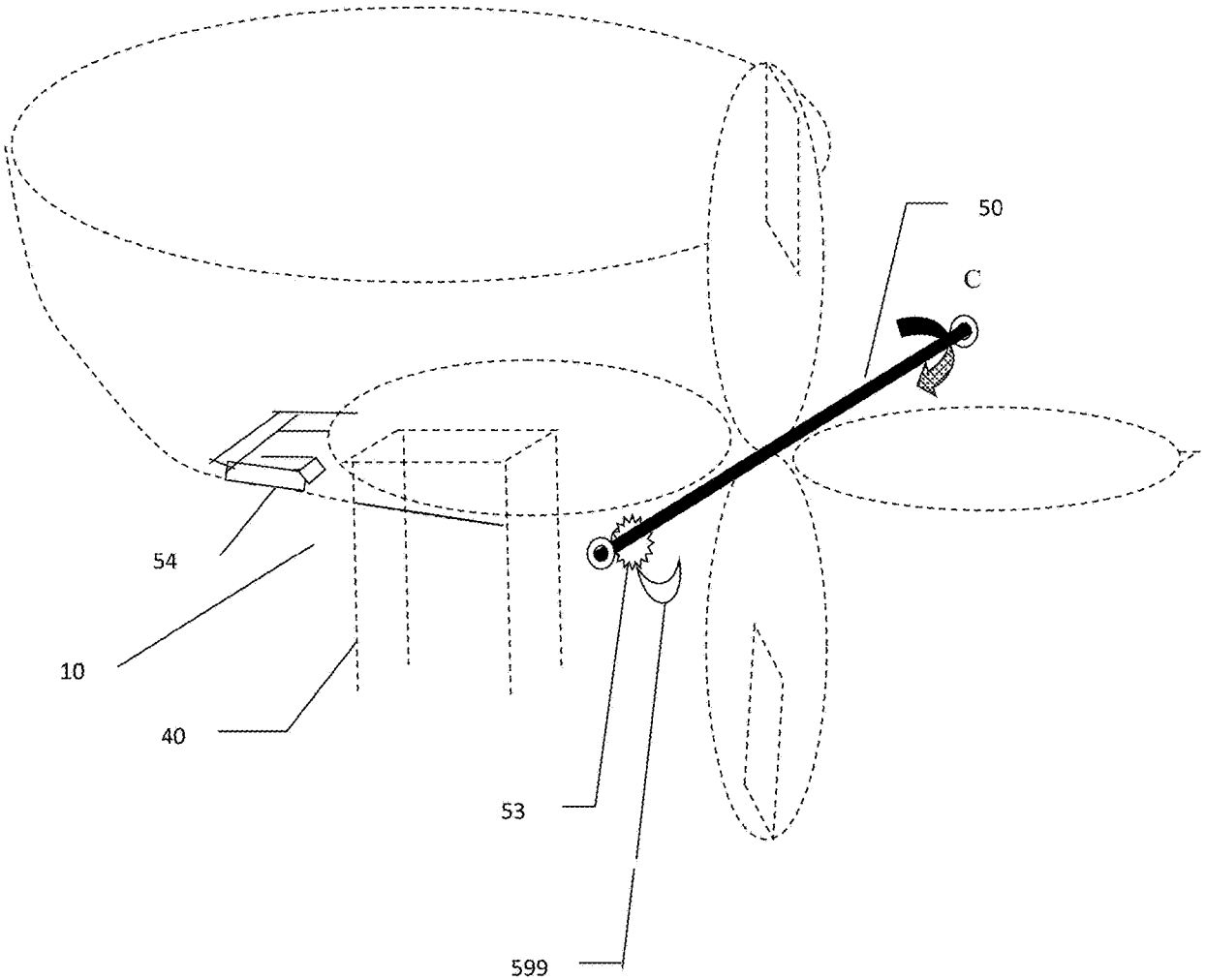
FIG. 5*c* shows the operation of a gravity switch. When the weight of fecal matter on a fecal plate becomes greater than the balancing weight then the horizontal fecal plate will rotate downward and fecal matter will unload.

FIG. 5*c* shows the operation of a gravity switch. Pawl 599 is weighted by weight 644. The pawl has a pivot 592. The pawl allows rotation in one direction, shown by C. When the weight of fecal matter on fecal plate becomes greater than the balancing weight 644, the pawl will release and the gear 53 can turn. Thus, the horizontal fecal plate 30 will rotate downward until the pawl 599 with weight 644 weighs more than the fecal plate 30 with a fecal matter loading.

Figure 5D:
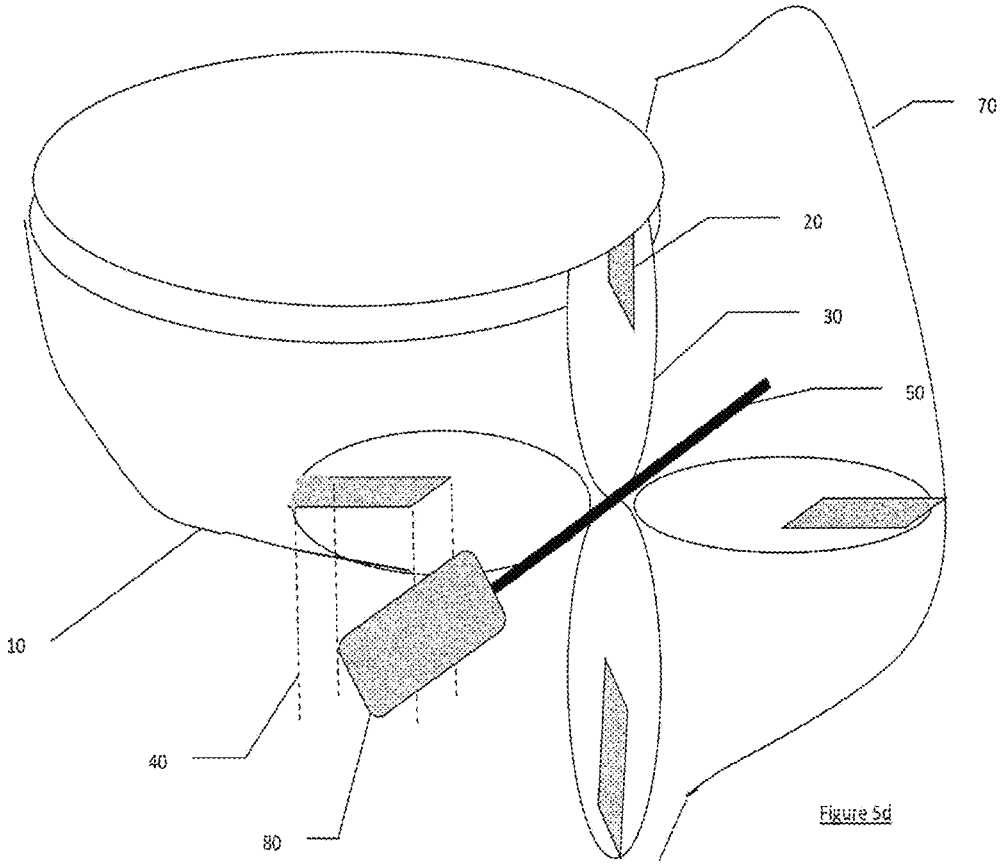
FIG. 5*d* shows an ultrasonic vibration cleaning unit and the back covering for the toilet bowl-rotary fecal plate unit.

FIG. 5*d* illustrates the use of an ultrasonic vibration cleaning unit 80. The unit is based on a piezo-electric crystal which can vibrate at ultrasonic frequencies. These vibrations are disposed to impinge on the fecal plate which has been rotated down into the lower part of the toilet bowl 10; the fecal plate is consequently rapidly cleaned. The shape of the rear outline 70 of the toilet is shown.

Figure 5E:
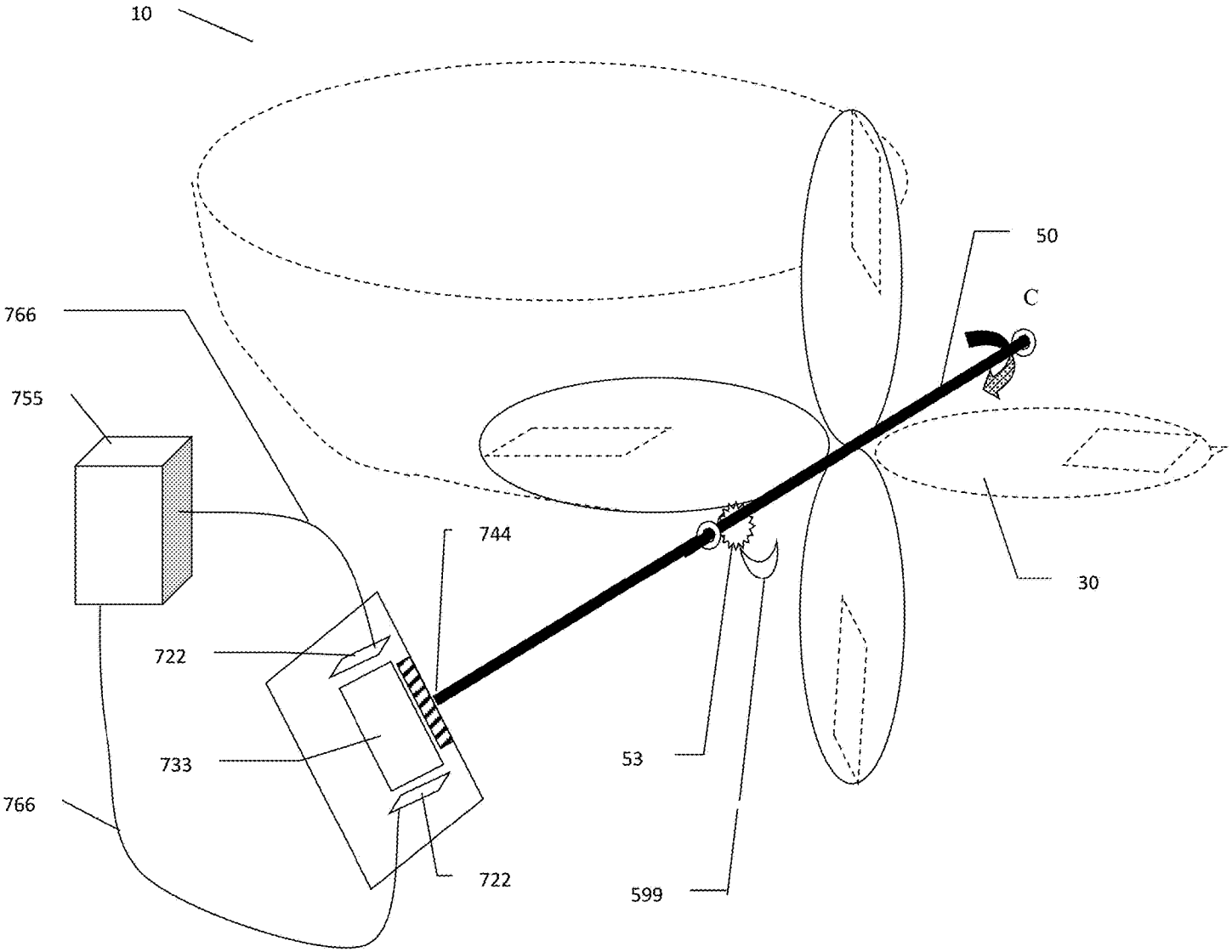
FIG. 5*e* shows an ultrasonic vibration unit as piezoelectric crystal in a housing driven by a high frequency electric source. The piezoelectric crystal is directly brazed to the rotating shaft to which the fecal plates are attached, and in use, tends to vibrate fecal matter free of the fecal plate.

FIG. 5*e* shows an ultrasonic vibration cleaning unit 80 as a piezoelectric-based ultrasonic vibration unit 80 with a piezoelectric crystal 733 in a housing 701, driven by a high frequency electric source 755, with wires 766 leading to electrodes 722 on the piezoelectric crystal 733. The piezoelectric crystal 733 is contained in a housing 701. The piezoelectric crystal 733 is shown directly connected 744 to the rotating shaft 50.

Figure 5F:
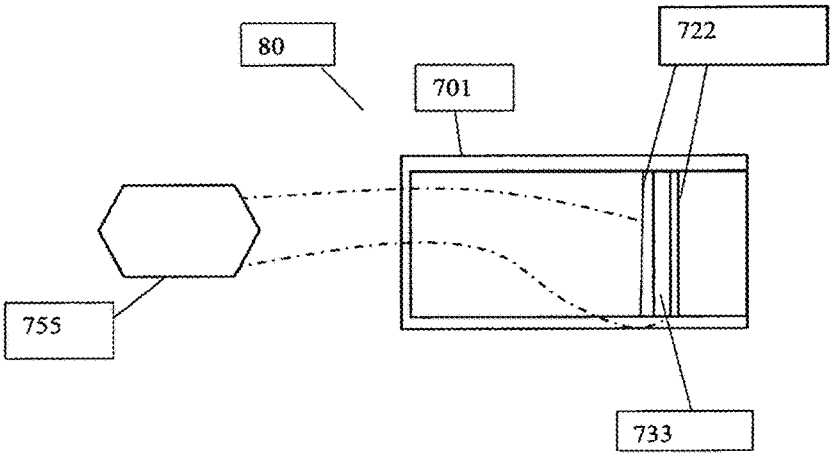
FIG. 5*f* shows the details of the ultrasonic (piezoelectric crystal) vibration unit.

FIG. 5*f* shows the details of the ultrasonic vibration cleaning unit. A housing 701 contains a piezoelectric crystal 733 which is activated by electrodes 722 driven by a high frequency electrical source 755.

Figure 5G:
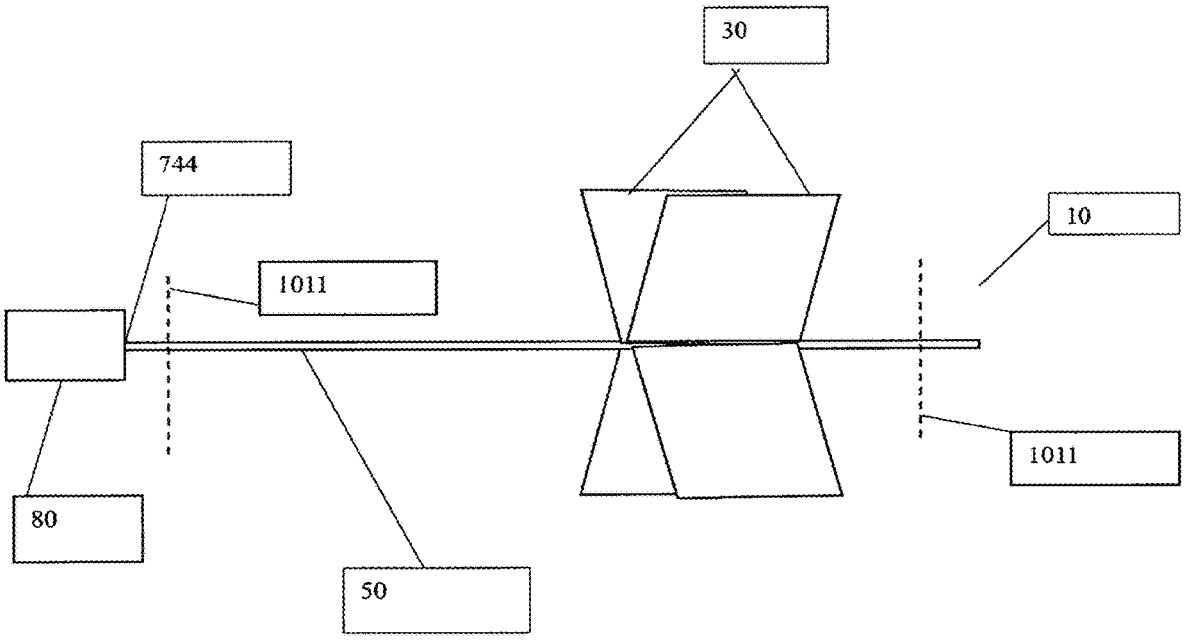
FIG. 5*g* shows the attachment of the ultrasonic vibration cleaning unit to the rotating shaft to which the fecal plates are also attached.

FIG. 5*g* shows the attachment 744 of the ultrasonic vibration unit cleaning unit 80 to the rotating shaft 50, which the fecal plates 30 are also attached.

Figure 5H:
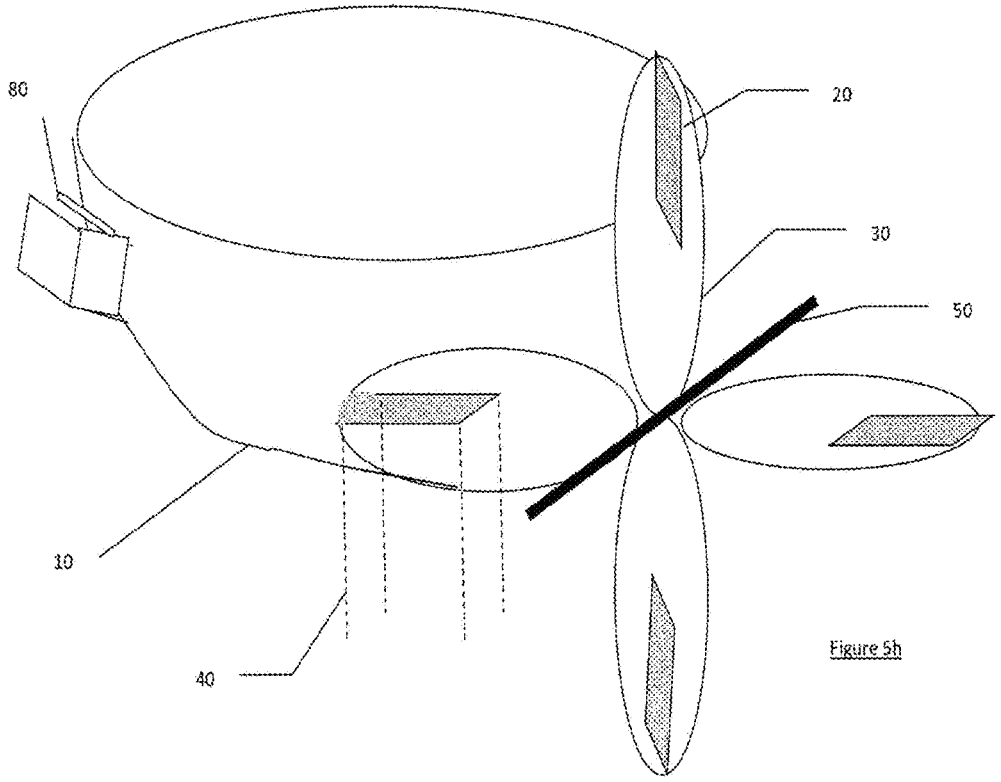
FIG. 5*h* shows an alternative mode of attachment of the ultrasonic vibration cleaning unit as a lower toilet bowl smart toilet placement.

FIG. 5*h* shows an alternative mode of attachment of the piezoelectric vibration unit 80 as a smart toilet lower bowl base 10 placement. This mode may consist of one or more ultrasonic vibration units 80 attached to the lower toilet bowl 10. In this mode, (see insert) the attachment 744 may be to the smart toilet base 10 utilizing a strong epoxy; or it may attach to a metal plate 7001 placed in an opening 1011 where the attachment 744 of the ultrasonic vibration unit 80 to the metal plate 7001 may be a strong epoxy or brazing. The metal plate 7001 is bonded to the smart toilet bowl 10.

Figure 5I:
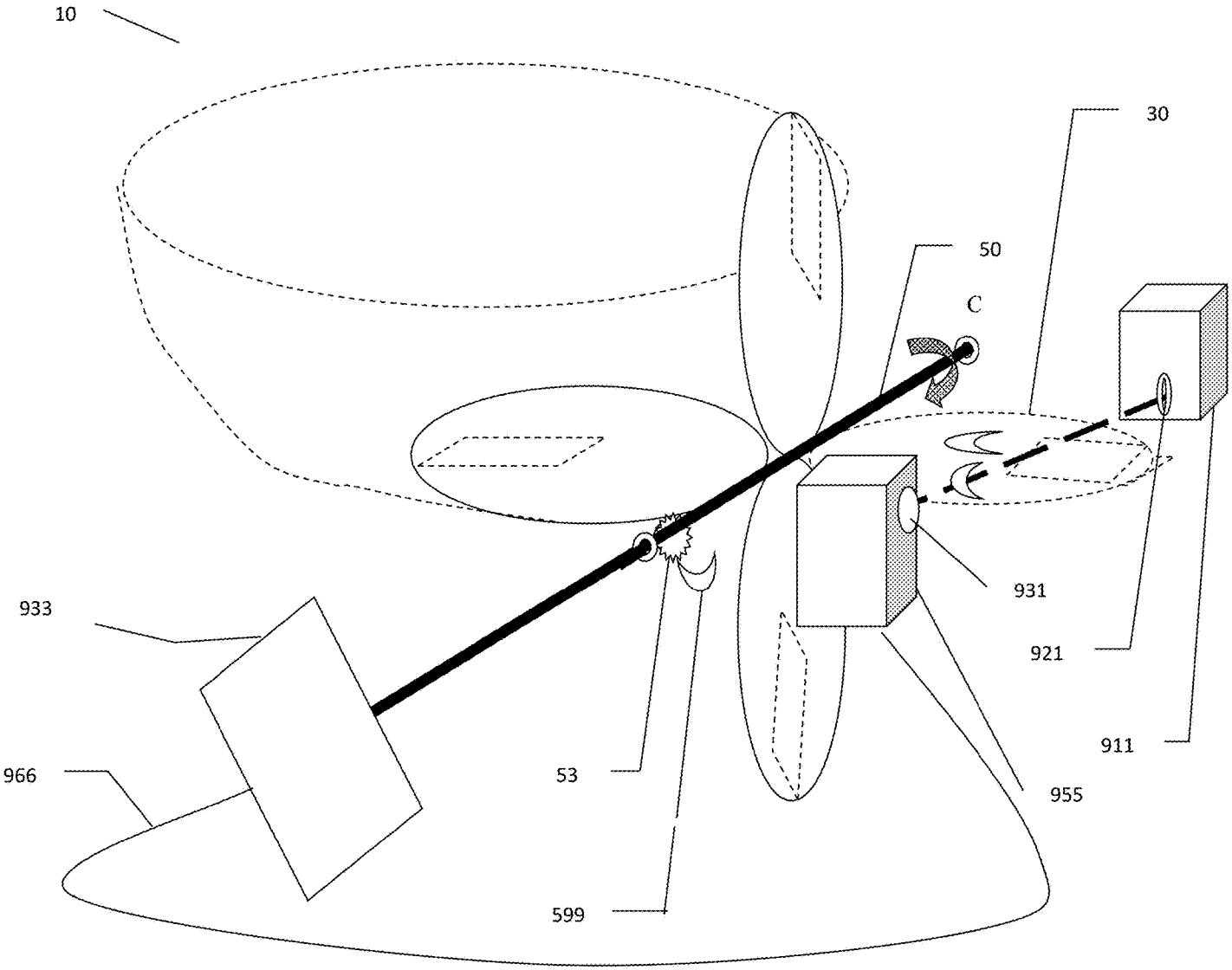
FIG. 5*i* shows an electric motor which is connected to a photoelectric circuit and a photoelectric cell. When this light is diminished by fecal matter blocking its way, the photo-cell circuitry activates the motor and turns shaft to swing the fecal plate into a vertical position.

FIG. 5*i* shows an electric motor 933 which is connected 966 to a photoelectric circuit 955 and a photoelectric cell 931, a light-emitting diode 921 and circuitry 911. A light beam (heavy dotted line) shines from the light emitting diode 921 and is received by the photocell 931. When this light is diminished by fecal matter blocking its way, the photo-cell circuitry 955 activates the motor 933 and turns shaft 50 to swing the fecal plate 50 into a vertical position.

It should be noted that the mechanisms herein can be implemented by manual means, e.g., periodic, occasional flushing of accumulated fecal matter, by turning or operating a valve. This and other functions can be implemented by mechanical or electrical timers.

Similarly, although it is illustrated that the fecal plate 30 is deliberately rotated into a cleaning position, yet, as understood in the arts, sensors, optical or weight-driven can initiate the rotation of a fecal plate 30 into a cleaning position, as fecal matter is detected accumulating of the fecal plate 30, with some specified time delay.

Figure 6:
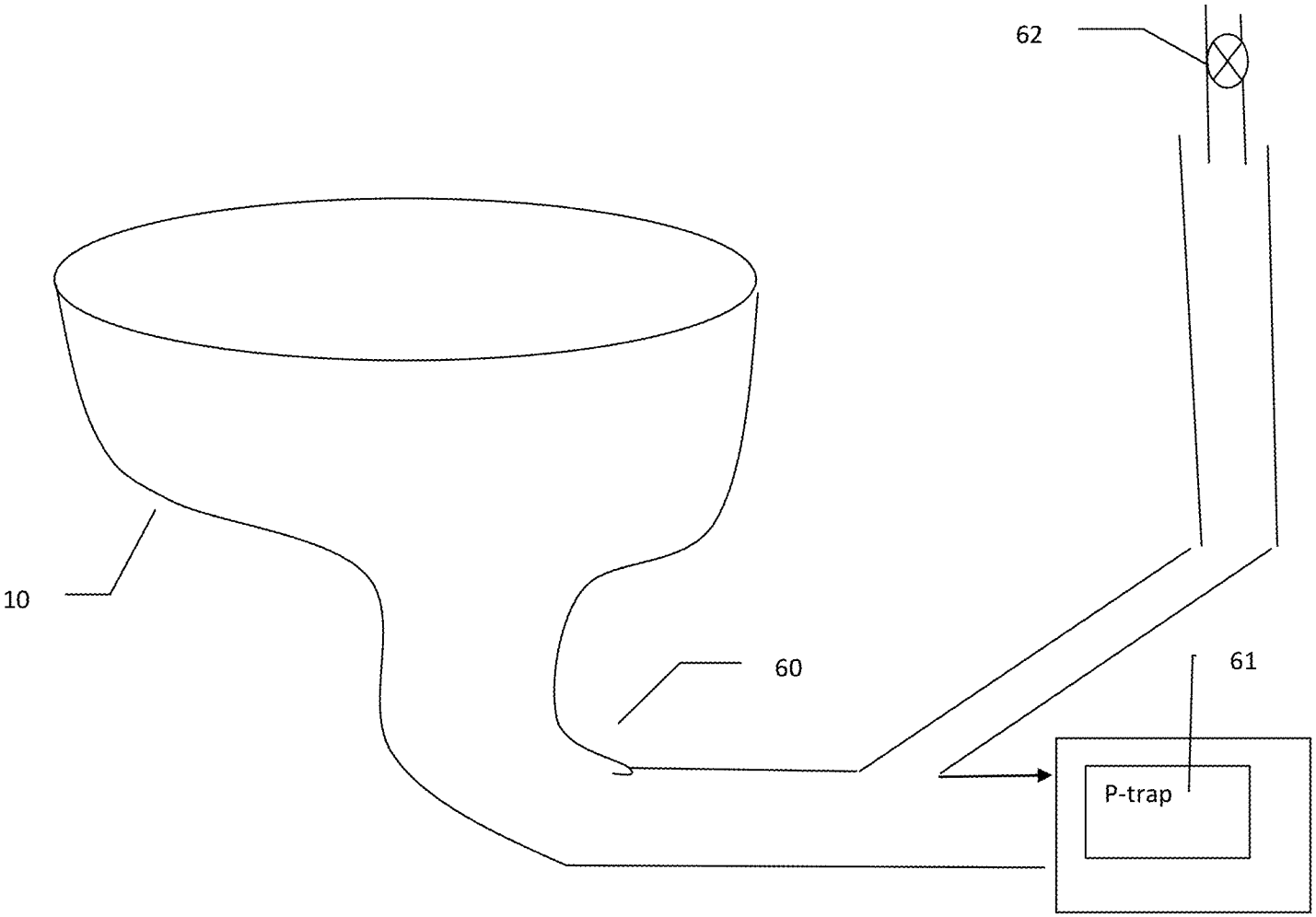
FIG. 6 shows a connection to a supply and waste water system for periodic, occasional flushing of accumulated solid wastes.

FIG. 6 illustrates that a supply water source, via a valve 62, is allowed to flush the accumulated solid fecal matter from the toilet bowl 10 which has accumulated in a small holding pipe 60, out to a waste water system through a usual p-trap 61 (or similar).

Figure 7:
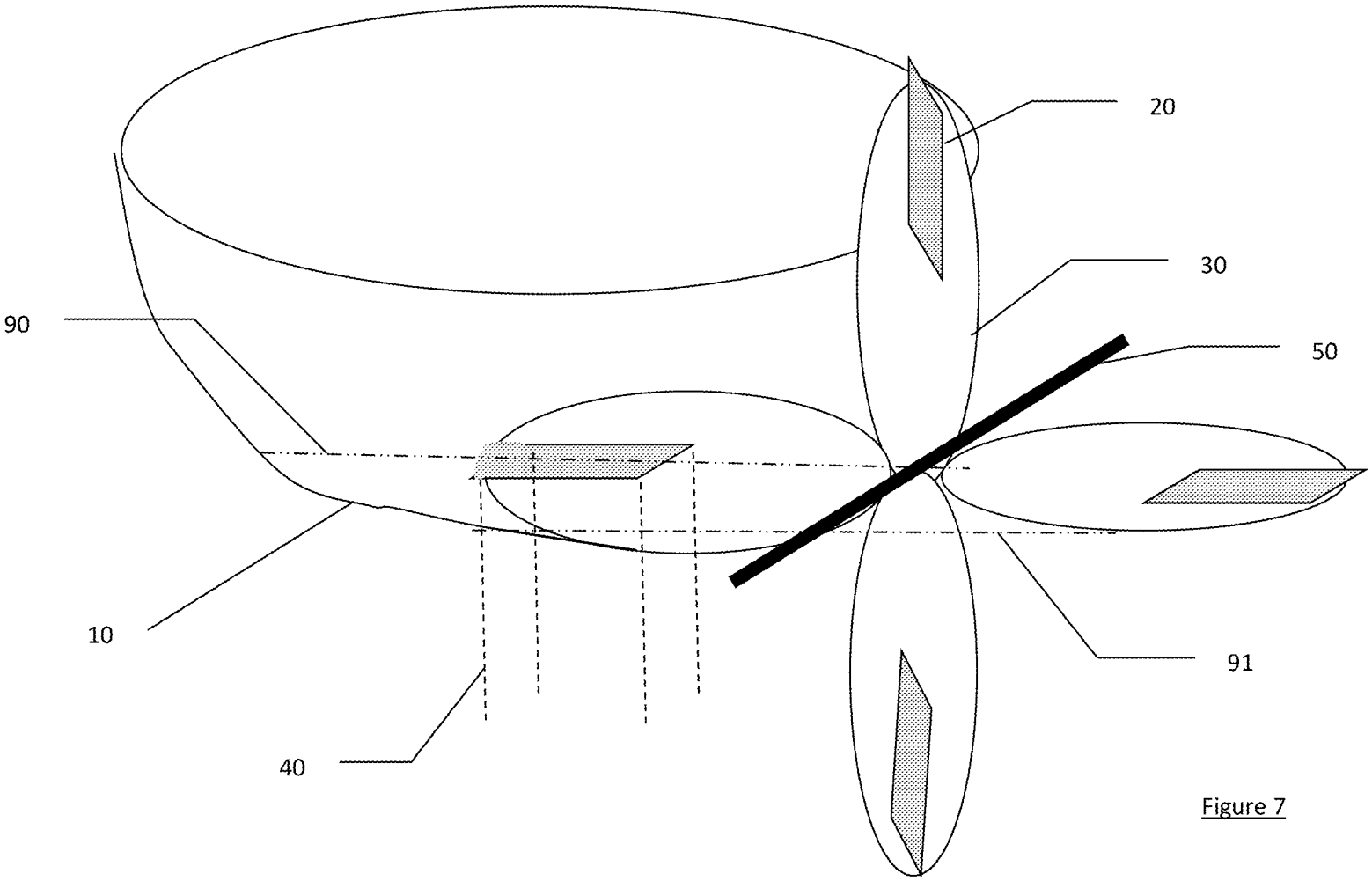
FIG. 7 shows a level for a lighter-than water oil/fluid odor trap substance as it floats on the main body of water contained in the lower part of the toilet bowl.

FIG. 7 shows the lower part of the toilet bowl 10 with a level 90 of lighter-than-water oil/fluid and a lower level 91 of water. If the level of water is deep enough, and a number of screen-type baffles are utilized, the floating lighter-than-water oil/fluid will not be entrained when the small holding pipe (FIG. 6, 60) is flushed, because the downward vertical velocity will be minimized.

A variety of materials can be used in the construction of the different modes of the invention. A primary candidate for the fecal plates is a polytetrafluoroethylene coated metal.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

It is claimed:

1. A toilet for minimizing water usage, connectable to a modern urban sewage system having a supply water system and a waste water system, comprising:

a toilet bowl with an upper and lower part wherein the lower part contains water;

a fixed waterless urinal unit, wherein the fixed waterless urinal unit utilizes a floating fluid lighter than urine and wherein the floating fluid traps odors of the urine;

four fecal plates uniformly disposed on a rotatable axis wherein one of the four fecal plates is disposed to receive fecal matter;

a mechanism to rotate the one fecal plate disposed to receive fecal matter into water in the lower part of the toilet bowl wherein another one of the four fecal plates is rotated into the place of the fecal plate originally disposed to receive fecal matter;

an ultrasonic vibration cleaning unit disposed to clean the one fecal plate which received fecal matter when the one fecal plate is rotated into the lower part of the toilet bowl;

a holding pipe;

a connection to the supply water system and the waste water system;

a periodic washout of accumulated solid matter in the holding pipe wherein water usage is minimized and wherein the toilet is connectable to the modern urban sewage system having the supply water system and the waste water system, and wherein the minimizing water usage toilet is compatible with the modern urban sewage system having the supply water system and the waste water system.

2. The apparatus of claim 1 wherein the floating fluid is an oil.

3. The apparatus of claim 1 wherein the ultrasonic vibration cleaning unit is attached directly to the rotating axis and thereby to the fecal plates.

4. The apparatus of claim 1 wherein the ultrasonic vibration cleaning unit is attached to the lower part of the toilet bowl.

5. The apparatus of claim 1, further comprising:

a mechanical system of levers and gears to operate the rotation of the one fecal plate which received fecal matter into the lower part of the toilet bowl wherein the fecal plate is immersed in water.

6. The apparatus of claim 1, further comprising:

a gravity-operated mechanism wherein an accumulated weight of fecal matter on the one fecal plate which received fecal matter operates the gravity-operated mechanism and disposes the one fecal plate which received fecal matter to rotate down to the lower part of the toilet bowl wherein the fecal plate is immersed in water.

7. The apparatus of claim 1, further comprising:

a photoelectric cell wherein an accumulation of fecal matter disposes the photoelectric cell to operate electrical circuitry wherein an electrical motor is turned on and disposes the one fecal plate which received fecal matter to rotate down to the lower part of the toilet bowl wherein the fecal plate is immersed in water.

8. The apparatus of claim 1 wherein the fecal plates comprise polytetrafluoroethylene on metal.

9. A method for making a toilet which minimizes water usage connectable to a modern sewage system having a supply water system and a waste water system, comprising:

utilizing a toilet bowl with an upper and lower part wherein the lower part contains water;

incorporating a fixed waterless urinal unit wherein the urinal utilizes a floating fluid lighter than urine;

trapping odors of the urine utilizing the floating fluid;

having four fecal plates uniformly disposed on a rotatable axis wherein one of the four fecal plates is disposed to receive fecal matter;

rotating the one fecal plate which received fecal matter into water in the lower part of the toilet bowl by a mechanism;

cleaning the one fecal plate which received fecal matter by utilizing an ultrasonic vibration cleaning unit when the fecal plate which received fecal matter has rotated into the lower part of the toilet bowl;

collecting solid fecal matter in a holding pipe;

washing out periodically accumulated solid fecal matter by a valve connected to the supply water system and a connection to the waste water system;

connecting the toilet to a modern sewage system having the supply water system and the waste water system, and minimizing the toilet water usage.

10. The method of claim 9 utilizing an oil as the floating fluid.

11. The method of claim 9, further comprising:

attaching the ultrasonic vibration cleaning unit directly to the metal rotating axis and thereby to the to the fecal plates.

12. The method of claim 9, further comprising:

attaching the ultrasonic vibration cleaning unit to the lower part of the toilet bowl.

13. The method of claim 9, further comprising:

utilizing a mechanical system of levers and gears to rotate the one fecal plate which received fecal matter into the lower part of the toilet bowl; and immersing the one fecal plate which received fecal matter plate into water.

14. The method of claim 9, further comprising:

operating a gravity-operated mechanism wherein an accumulated weight of fecal matter on the one fecal plate which received fecal matter to rotate the one fecal plate which received fecal matter into the lower part of the toilet bowl; and immersing the one fecal plate which received fecal matter into water.

* * * * *